United States Patent [19]

Mori

[11] Patent Number: 4,640,683

[45] Date of Patent: Feb. 3, 1987

[54] KILN FOR FIRING HEAVY CERAMICS

[76] Inventor: Giorgio B. Mori, Crta. Alcora, Km 10,400, Castellon, Spain

[21] Appl. No.: 588,590

[22] Filed: Mar. 12, 1984

[30] Foreign Application Priority Data

Mar. 22, 1983 [ES] Spain ..... 520853
Mar. 29, 1983 [ES] Spain ..... 521117
Mar. 29, 1983 [ES] Spain ..... 521118

[51] Int. Cl.[4] ..... F27B 9/14; F27D 15/02; F26B 9/00

[52] U.S. Cl. ..... 432/134; 34/164; 432/82

[58] Field of Search ..... 432/82, 134; 34/164

[56] References Cited

U.S. PATENT DOCUMENTS 2,374,713 5/1945 Storrs ..... 432/134
2,917,297 12/1959 Schramm et al. ..... 432/134
3,184,224 5/1965 Shelley ..... 432/82
3,758,267 9/1973 Berk ..... 432/134
4,306,359 12/1981 Hoyt ..... 34/164

*Primary Examiner*—John J. Camby
*Attorney, Agent, or Firm*—Cushman, Darby & Cushman

[57] ABSTRACT

A transport surface for a kiln for firing heavy ceramic articles includes a loading, an unloading end, a chassis standing between the ends and a transport surface resiliently connected to said chassis; a drive motor for imparting vibratory motion to the transport surface portion is provided externally of a hearth in which the surface portion is disposed; a releasing guide is provided to facilitate movement of the surface portion in a selected direction upwardly and forwardly an extent sufficient to shift an article resting on the surface portion from the loading to the unloading end; loading and unloading devices are provided to automatically load and unload articles from the transport surface; the hearth includes conduits for carrying cooling air along the hearth on the outside thereof.

11 Claims, 10 Drawing Figures

KILN FOR FIRING HEAVY CERAMICS

The present invention refers, as indicated in the title of these specifications, to a kiln which has been specially designed for firing heavy ceramics, for example bricks and the like, but which is especially applicable for lighter ceramics, such as wall tiles.

As is known, kilns with this purpose known until now, are tunnel kilns in which the ceramic parts are inserted at one end and after a considerably long run, during which the parts are subjected to a suitable temperature, and then leave through the opposite end of the kiln, already fired.

Thus, combining the temperature of the kiln, its length, and the speed with which the parts move, combined with other premises which influence the firing process, such as the size of the parts, closeness to each other, etc., a work line can be established for the kiln, resulting in the foreseen degree of firing.

Conventionally, the transport of the parts takes place in different ways. One of them consists in the layout on the kiln of a hearth of rollers, animated by a rotating movement and acting as drag elements for the parts throughout same. This solution, which although costly can be valid for light ceramic parts, cannot be used in the case of heavy ceramic parts, since their weight, together with the high temperatures to which the rollers are subjected, make them sag, with the result that they rapidly become unusable.

For this reason, in heavy ceramics, trucks are used for shifting the articles, perfectly capable of withstanding the temperatures which they have to be subjected to.

However, this solution involves problems with numerous aspects, in which, apart from their cost, we should mention the thermal losses involved in heating these trucks on entering the kiln, which is then lost on leaving. The interruptions in the operative process of the kiln should also be quoted, derived from the negative effects which the ash produced in combustion have on the truck shifting system, when pulverized coal is used as a heat source, supplied by the respective injectors, or through the effect of broken parts, whose fragments affect these shifting elements. Obviously, in these cases, the kiln has to be stopped, emptied, and after it has cooled, cleaned.

Another problem inherent to this type of transport is due to the trucks themselves, as this solution calls for a large cross-section in the kiln tunnel, which means that the inlet and outlet are quite large, consequently involving a considerable loss of heat and which, to offset this loss, require the kiln to be longer, to be able to have a sufficiently long firing area in it, where the temperature reaches preset levels.

All these problems are solved in the heavy ceramics firing kiln making up the object of the present invention, whose basic characteristics affect just the transport system for the parts, which takes place in a completely different manner to the conventional way.

To be more precise, the parts are transported through a continuous stiff hearth, subjected to a vibrating movement which, through the adequate transmission means, lead to a pulsating movement for the parts, placed freely on the hearth; these parts are subjected to micro-shifting which takes them forward through the kiln, and whose range can be regulated as required.

This system enables heavy ceramic parts to be placed direct on the hearth, without this affecting the structure of the transport mechanisms, whatever the temperature of the kiln; hence, the cross-section of its tunnel can be reduced to the dimensions determined by the actual size of the parts, consequently narrowing the inlets and outlets, thus limiting the heat losses through these areas.

The continuous, smooth construction of the hearth also avoids problems derived from parts breaking, or from ash left after combustion, as these are dragged along with the actual parts being fired, and ejected outside with the latter, with the drive devices.

These drive devices can be located outside the firing chamber, which means that possible failure in them can be repaired much quicker and easier and, even when it is necessary to stop these drive means, the failure in question can be overcome without having to let the kiln cool.

Through the doubling of the drive transmission devices, the special construction of the kiln hearth enables two work strips to be established in it with opposite working directions, so that one of the kiln inlets forms the entrance of a working strip and the outlet of the other, the same thing happening in the other opening, but the other way round; thus, the heat given off by the parts in one working strip in its prior cooling process before leaving the kiln is taken advantage of by the working strip to achieve preheating of the parts going into the kiln.

Nevertheless, there can be only one working strip, or the number of working strips can be more than two.

All this is achieved with an extremely simple structure, with the consequent favourable effect on the economic aspect, this transport system also enabling the length of the kiln to be considerably shortened.

For this, a drive unit transmits movement through an eccentric to the structure forming the hearth, which is mounted on a support chassis through elbowed connecting rods which are hinged to that chassis by its middle area and whose bottom end is placed between a pair of rugged springs. The action of the eccentric makes the hearth shift against the tension of a set of springs, which are slowly loaded, and when this eccentric reaches its maximum eccentricity point, and this brusquely disappears, the recovery of these springs causes a likewise sharp movement of the hearth, upwards and forwards which, suitably timed, in turn moves the parts in the same direction, which becomes a small advance for them, which is repeated continuously and at variable speed, which is adjustable in keeping with the rotation of the eccentric.

The layout of the connecting rods corresponding to one working strip of the hearth, opposed to those of the adjacent strip, means that the shifting of the parts in one of them takes place in the opposite direction to the other, in order to achieve the heat transmission sought in the input and output areas of the kiln, as explained hereinabove.

Due to the high temperature to which the firing chamber has to be subjected, which can reach 1,200° C., it is obvious that if this temperature reaches the drive transmission devices, they would immediately deteriorate. For this reason, an insulating layer must be placed between the actual hearth and the drive devices, with sufficient capacity to ensure that these drive devices are kept perfectly insulated from the high temperatures existing in the firing chamber.

For this, in the kiln which the invention proposes, it has been foreseen that the trays making up the sliding surface of the hearth, made of corundum, vitrocorundum or any other suitable material, rest on a layer of fireproof bricks, which ensures a suitable degree of temperature for the drive devices.

Now then, due to the fact that this insulating mass has to be subjected to the vibrating movement necessary to shift the parts, it is also obvious that their weight must be reduced to the minimum, since the power necessary in the drive motor, its power consumption, the stiffness in the support structure for the hearth and the tension to be supplied by the recovering springs acting on the connecting rods are proportional to that weight.

In this connection it has been foreseen that in accordance with the hearth base, there is a series of metal tubular elements, arranged lengthwise, on which the minimized layer of fireproof brick rests. These tubular elements act as heat dissipating means, for which a cold air current is made to pass through them, thus cooling the pipes and, consequently, establishing an extremely efficient insulating curtain.

Optionally, the fireproof bricks can be replaced by a series of U-shaped sheets, attached to the bottom tubular structure by means of spacer brackets and stiffening rods, on which the trays rest, forming the sliding surface for the parts; the space defined between these U-shaped sheets and the tubular elements is filled by a wool mass with high thermoinsulating power.

Another feature of the invention is centered on the loading means of the ceramic parts with respect to the pulsating hearth and of unloading them after completing the firing process.

In this connection, loading takes place through a conveyor belt, arranged transversally in the kiln input, fed in turn by a belt which precedes it, in line with it, making the transfer from the first belt to the second, with the possibility of maintaining the space between parts, reducing it or increasing it, and arranging this supply by groups of parts, forming a transversal alignment whose size corresponds to the inner width of the kiln, groups of parts supplied in sequences and through suitable programming.

Once the ceramic parts are suitably placed on the belt, facing the kiln mouth, a hydraulic or pneumatic pusher drags them inside it.

On leaving the kiln, the fired ceramic parts fall onto a transversal detainer, causing it to drag forward, at the same time as they are gradually placed on another transversal conveyor belt, thus ensuring that possible errors of misalignment for each group of parts during their path inside the kiln can be corrected, by the more advanced parts being curbed by this detainer, during the period of time which enables all of them to fall on it. At this moment, the whole assembly, including the conveyor belt, is projected lengthwise, the kiln output coming away, and the conveyor belt immediately starts to work, to eject the group of parts sideways, this assembly then returning immediately to its original position, to start a new extraction cycle again.

It should also be mentioned, that to ensure that the parts move inside the kiln without the possibility of interlockings occurring with respect to possible side irregularities of the trays making up the sliding surface, the arrangement of fire-proof steel rods has been foreseen, which act as guides for this purpose; there can also be rods in the middle area of the trays, acting as spacers between different longitudinal alignments of parts.

To complete the description which is being made, and in order to understand the features of the invention better, a set of drawings is accompanied to the present specifications, as an integral part thereof, in which the following has been shown, with an illustrative and unlimiting nature:

FIG. 1. Shows a partial view, in a side elevation of a kiln for firing heavy ceramics made in accordance with the object of the present invention.

Figure 1:
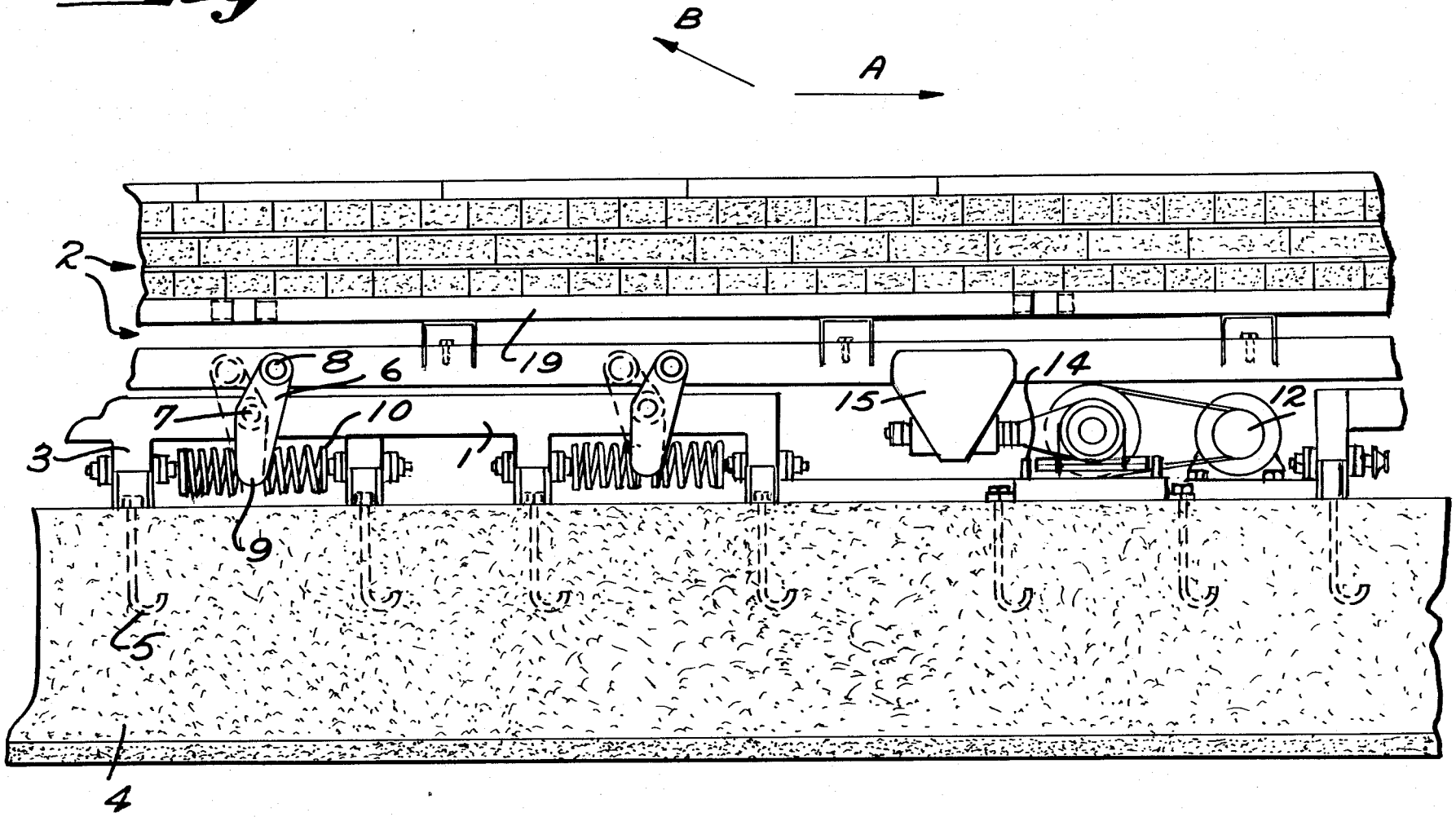
Figure 2:
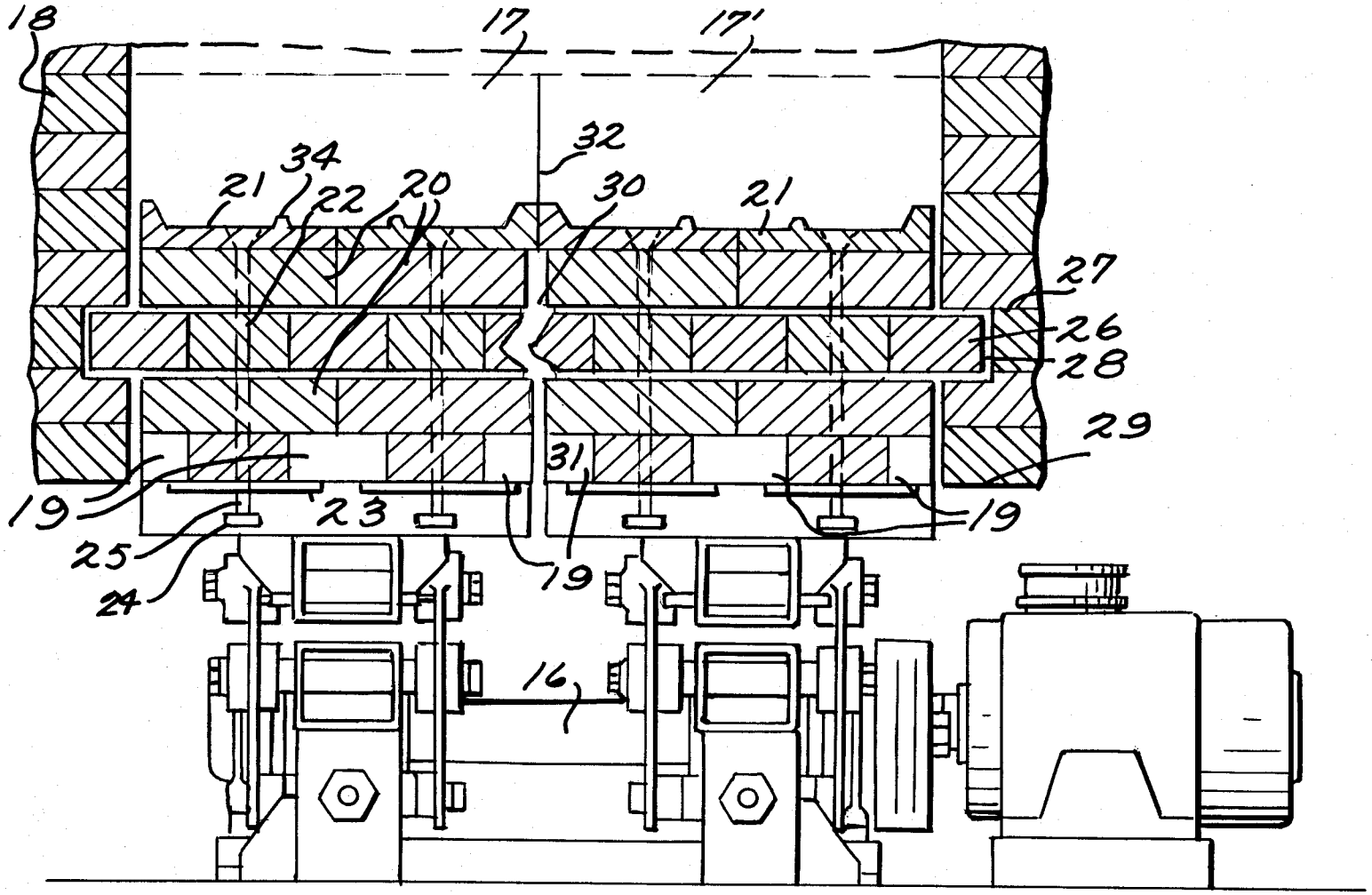
FIG. 2 shows a cross-section of the same assembly illustrated in the previous figure.

In the light of these figures we can see how the kiln for firing creamics which the invention proposes includes a chassis 1, designed to support the hearth 2 on which the parts have to slide, a chassis which includes a plurality of feet 3, through which it is fixed firmly to the ground 4 by means of hooks 5, as illustrated in FIG. 1, or through any other conventional anchoring system.

The hearth 2 is related with the chassis 1 through a plurality of connecting rods 6,obtusely elbowed, connecting rods which in their middle area are linked in 7 to the chassis 1, which at their top end 8 are linked to the sides of the hearth 2, and which at their bottom end include a gudgeon pin 9 through which that end works between a pair of springs 10 and 11, made between the respective pair of support feet 3 of the chassis 1.

This assembly is assisted by a drive element 12 which transmits its turning movement to an eccentric 13 in charge of supplying the vibrating movement to the hearth 2, for which the said eccentric 13 acts on an arm 14 joined integrally to the hearth itself 2, by means of large side brackets 15.

Obviously, the hearth 2, although it has not been shown in the figures, will be framed at the side and top by the wall forming the tunnel of the kiln, the drive devices being located under the hearth, outside the firing chamber, and with direct side access from outside the kiln.

In accordance with the construction disclosed, the rotating movement of the drum 12, through the eccentric 13, causes a progressive shifting of the hearth 2 in the direction of arrow A, shown in FIG. 1, tilting the connecting rods 6 on their tilting shaft 7, against the tension of the springs 10.

When the cam reaches a point in which it forms an abrupt staggering, the hearth 2 is released from the said traction in the direction of the arrow and the springs 10 cause sharp tilting in the opposite direction of the connecting rods 6, which is transformed in an abrupt displacement of the hearth in the direction of the arrow shown with the letter B in FIG. 1, i.e., a displacement slanting upwards and in the opposite direction to the arrow A.

This displacement B, when it has reached a suitable value, causes a small jump of the ceramic parts which, as it is slanting, makes them move forward with respect to the hearth, in the opposite direction to arrow A. This sharp displacement of the connecting rods 6 in the feed direction for the parts, is dampened by the set of springs 11 arranged in opposition to the aforementioned springs 10.

Figure 3:
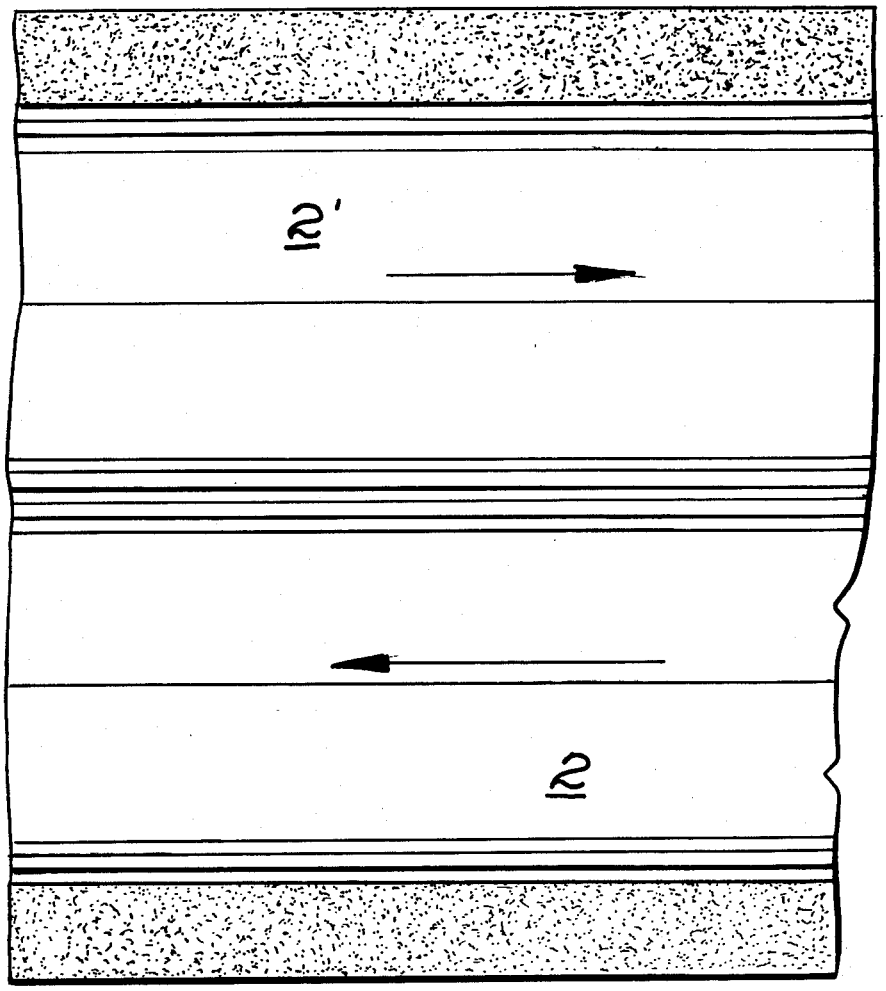
FIG. 3 shows a schematic representation in plan view of the hearth of a kiln in which the different feed directions for the parts have been indicated with arrows, between one work band and another.

When there are two adjacent working bands, as illustrated in the figures, and especially in FIG. 3, the connecting rods 6 corresponding to one band have an elbow shaped in the opposite way to the connecting rods 6' corresponding to the other band, supplying movement to both bands or hearths 2 and 2' through the motor 12, but with different eccentrics 13, although they are mounted on the same shaft 16, and driven by the same motor 12.

The feed motion is achieved by very close and small displacements, which means that the power necessary in motor 12 is relatively low; this involves a considerable reduction in the consumption of energy with respect to conventional transport systems.

Neither is it necessary to heat any accessory element, other than the actual parts to be fired and parts of different shapes and sizes can be shifted on the hearth, without this affecting the construction of the drive system in the least, which will only depend on the weight foreseen to be transported on the hearth, regarding the power to be supplied.

To fix the suitable degree of thermal insulation between the firing chamber 17, formed by the actual hearth or hearths 2, and by the kiln wall 18, with respect to the transmission devices, it has been foreseen that on the cross members on which the hearth commences at the bottom, there is a series of tubular elements 19, through which cold air is made to pass, and which holds a layer of fire-proof bricks 20 whose thickness is minimum, since the possible heat transmitted to the lower face of this block 20, is dissipated by the cold air which passes through the conditions established by the tubular elements 19, which act like a cooler.

In order to achieve good thermal transmission towards the cooling air, the tubular elements 19 will be made of metal.

The block of fireproof bricks is fixed to the tubular structure 19 by means of the actual trays 21 which form the sliding surface for the parts and which, as we have already said, will be made of corundum, vitrocorundum or some similar material, and with the assistance of shanks 22 which, with their head inlaid in the bottom of the trays 21, cross the mass of fireproof bricks 20 and, after the respective retention cross members 23, have the binding nuts 24 with the mediation of springs 25 which act as absorbers of the possible dimensional variations due to expansion and contraction, according to the changes in temperature.

In this way, the weight of the hearth can be reduced to the maximum, maintaining the suitable insulation coefficient in it.

Due to the fact that the hearth has to move in an upward-downward direction with respect to the kiln wall 18, a side opening is made between these elements; in this connection, it has been arranged that the layers of fireproof brick 20 stretch to the middle area 26, forming, with hollows 28 of the kiln wall, labyrinthic steps 28 which hamper heat transmission through these areas. Elastic joints 29 placed in the opening of these grooves assist this insulating effect.

When there are two hearths in the kiln, as in the example of embodiment illustrated in the figures, since these hearths are subjected to opposite pulsating movements, and consequently to relative displacements, there is also a labyrinthic step 30 in the area joining both hearths, likewise assisted by an elastic joint 31.

In this case, a possible compartment formation has been foreseen between the two firing sub-chambers 17 and 17', corresponding to these hearths, which is achieved by means of a sliding partition wall 32, made between them, and equipped to vary its position in height, becoming an operative partition of varying size, which enables the convection between both sub-chambers 17 and 17' to be regulated.

On the trays 21, refractory steel side rods 33 have been arranged, which form perfect continuity for the edges of the parts to be fired, preventing them possibly being withheld due to possible staggering which may be caused between the joins of the different sectors of the hearth, as already mentioned. The existence of other inner rods 34 has also been foreseen, likewise arranged lengthwise, which enable the physical insulation between different longitudinal alignments of parts to be made, moving on each hearth, so that the parts in each alignment are kept perfectly independent with respect to the adjacent alignment.

Figure 4:
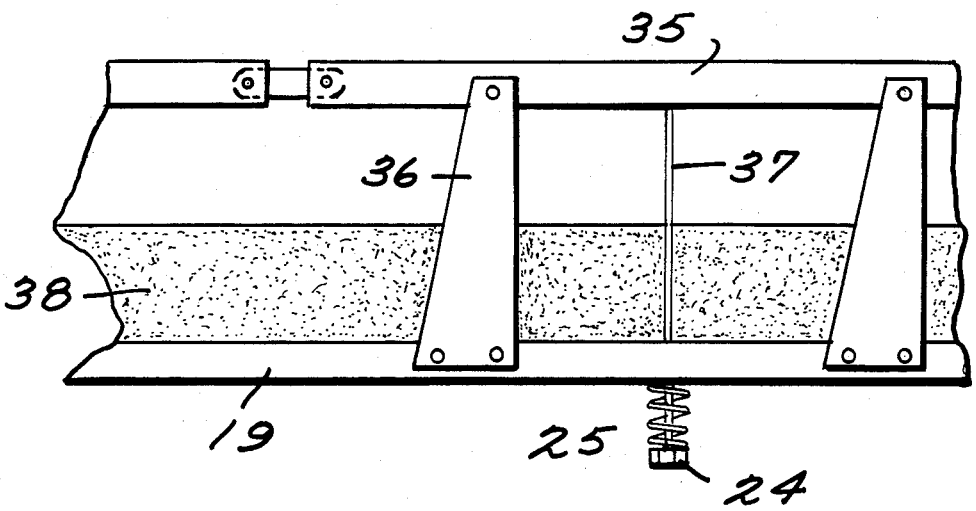
FIG. 4 shows a side elevation detail of the isulation system of the drive transmission elements with respect to the firing chamber, in its metal version.
Figure 5:
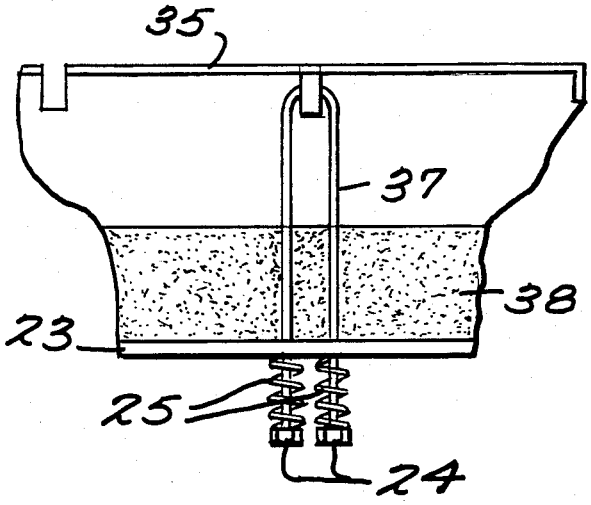
FIG. 5 shows a cross-section of the detail illustrated in the previous figure.
Figure 6:
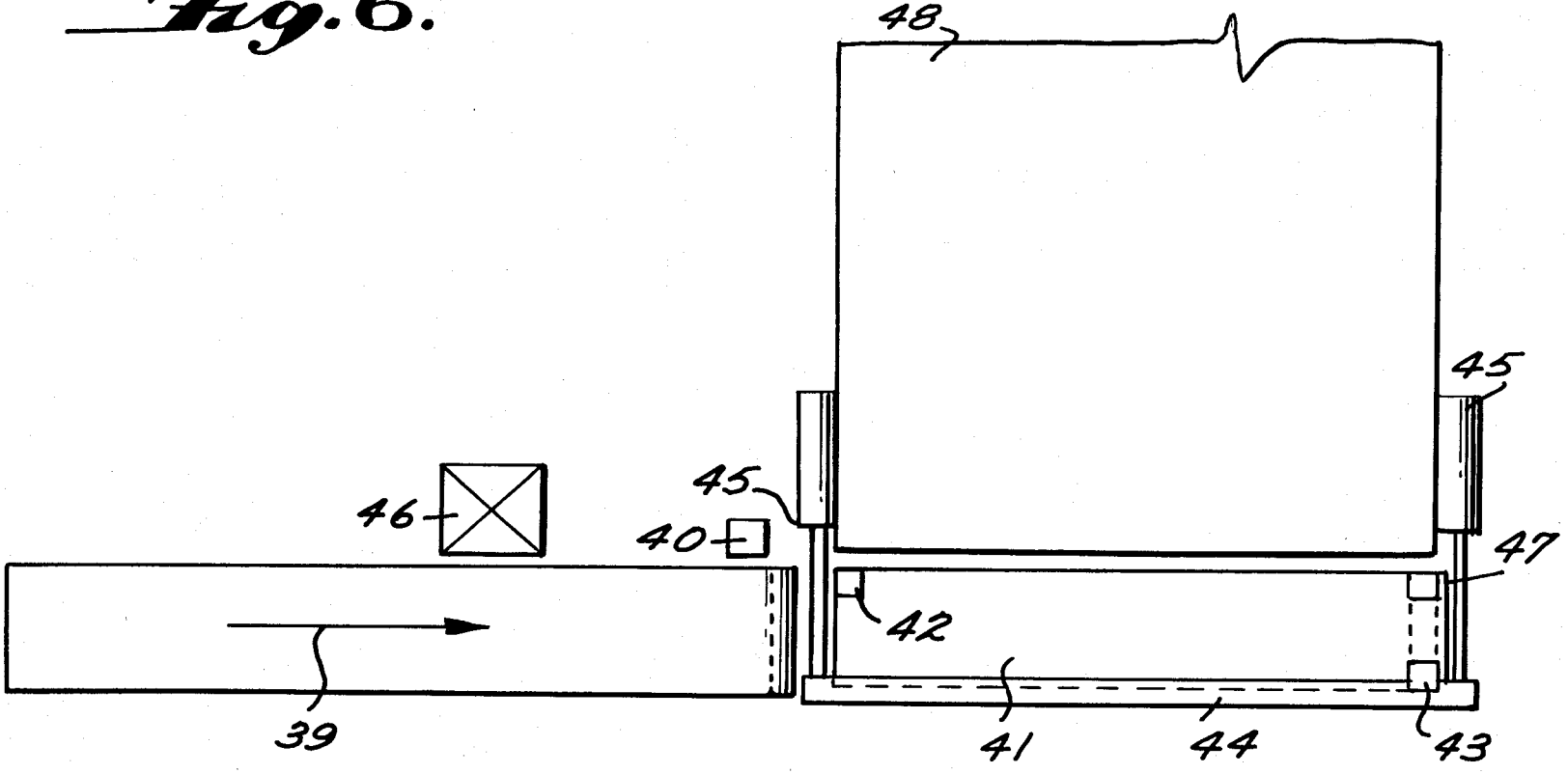
FIG. 6 shows a schematic plan view of the ceramic parts feeder to the kiln.
Figure 7:
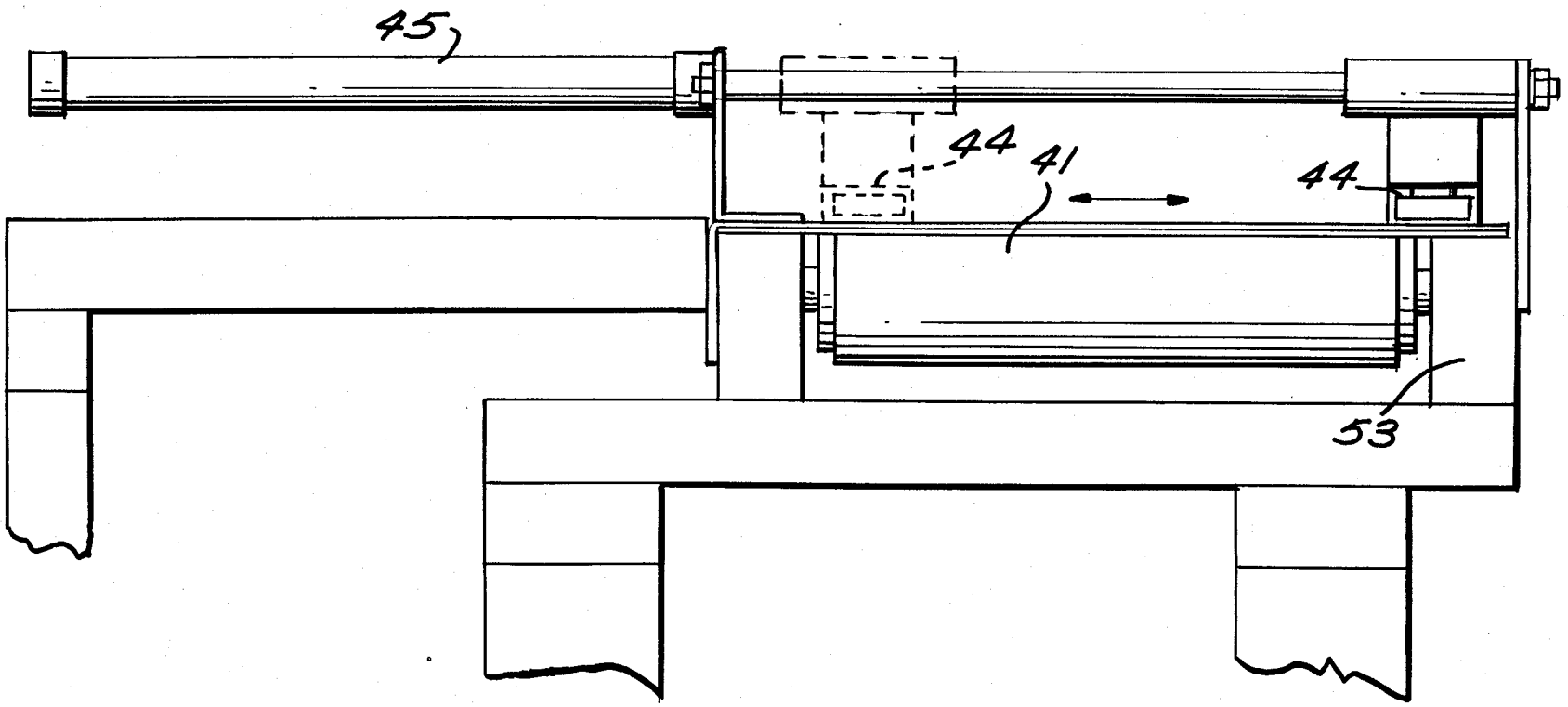
FIG. 7 shows a side elevation detail of the same assembly, shown in the previous figure.
Figure 8:
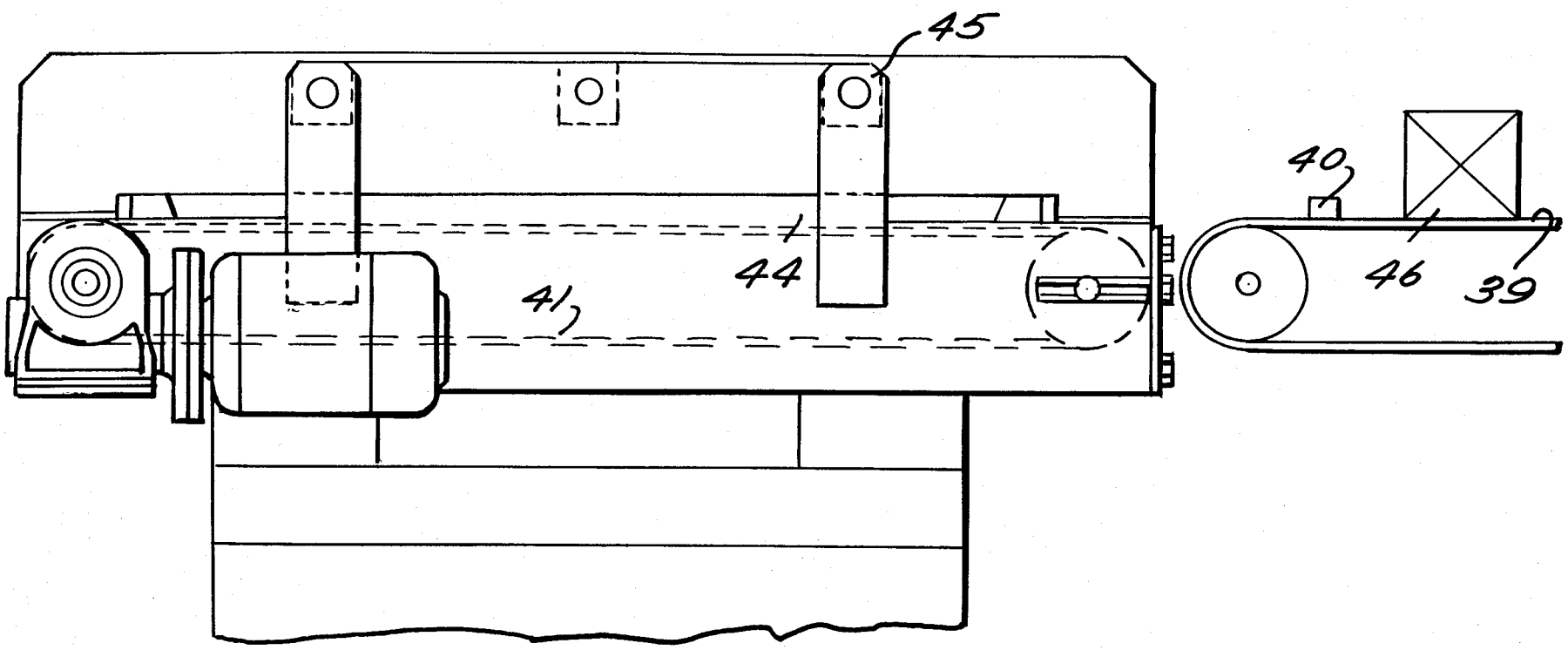
FIG. 8 shows a front elevation view of the same assembly.

However, insulation can also be made in a metal version, as compared with the ceramic type mentioned above, as illustrated in FIGS. 4 and 5. In this case, the trays 21 will still be made of refractory material, resting on U-shaped metal sheets 35, with their concavities facing downwards, backed sideways through their side branches, which rest on the tubular elements 19 through the brackets 36 which also act as spacer elements and which preferably will be a trapezoidal straight section. Apart from these brackets 36, in fixing the metal sheets 35 to the tubular elements 19, there are U 37 rods which cross operatively opposing holes in the adjacent side branches of these sheets and whose arms stretch parallel downwards, after passing the cross members 23, to receive, as in the ceramic solution, nuts 24 with the mediation of absorber spring 25 of possible expansion.

In the space formed between the sheets 35 and the tubular elements 18, there is a layer 38 of light insulating material, mentioned above.

Since the grooved sheets 35, like the tubular elements 18, can be subjected to longitudinal expansion, it has been foreseen that the different sectors making them up fit together telescopically, as can be seen for these tubes 19 in FIG. 1.

The kiln is loaded through a first conveyor belt 39, which receives the parts by any suitable means, whose loading and respective stopping is determined by a detector 40. This conveyor belt is aligned with a second conveyor belt 41, whose length corresponds to the width of the kiln 18 at its inlet, which is opposite it.

This second conveyor belt 41 moves at the same time as belt 39 and receives the parts supplied by the latter, being able to turn at the same speed, at a greater speed or at lesse speed, according to the spacing between parts foreseen for them, in a transversal direction, inside the firing chamber 17.

When a line of parts is placed on this second belt 41, which is detected through the photo-emitter 42-photo receiver 43 assembly, or by any other conventional means, a pusher 44, which shifts through hydraulic or pneumatic cylinders 45, pulls the parts inside the kiln.

Each work cycle, i.e. each loading of a line of parts, transversal with respect to the kiln, is determined in time by a timer 46 which fixes the feed gaps foreseen and which obviously enables each transversal line of parts to be spaced longitudinally in the kiln, in order to fix the empty spaces between them which absorb possible differences in speed, due to slight differences in weight of the parts, different roughness in their support surface on the kiln hearth, etc.

In accordance with the foregoing, the drive motors of belts 39 and 41 will start at preset intervals by the timer 46, while they are stopped through the effect of sensors 40 and 43, there also being another sensor 47 in the second belt, preferably a microswitch, which, due to the effect of the first ceramic part, acts on the drive electrovalve of the hydraulic or pneumatic cylinders 45 for the consequent shifting of the pushing device 44.

By giving the second belt 41 less speed than belt 39, the ceramic parts will be placed on that second belt in a contacting manner, thus achieving maximum advantage of the effective space of the kiln hearth, and giving the second belt greater speed than the first, spacing between parts will be achieved which is particularly suitable when longitudinal alignments of them are sought throughout the kiln in a spaced manner, naturally or with the aid of refractory steel rods fixed in the hearth, as mentioned above and marked with reference numbers 33 and 34.

Unloading takes place with the assistance of a transversal stop 48, with respect to the shifting shaft of the hearth, related with a hydraulic or pneumatic actuator, so that when the ceramic parts touch this stop, on sliding on the hearth, they make it drag with a speed which will be determined by the step established in the hydraulic or pneumatic feed circuit of the actuator 49, thereby cancelling the lack of feed balance of the different parts corresponding to a transversal alignment, since the displacement of these parts will always be greater than that of the detainer stop 48 and, throughout its run, all the parts in one line will touch it, thus ensuring perfect alignment on leaving the kiln.

After the first drive stage of the detainer stop 48 by the thrust of the actual parts, in the majority of their complete course, the actuator works, causing a second displacement stage in which the transversal conveyor belt 50, on which all the parts corresponding to an alignment have been placed, also shifts, so that a considerable space is achieved between this alignment and the next.

When the assembly reaches a limit situation, detected by a sensor, the conveyor belt starts working, causing the instantaneous side ejection of that line of parts; after they are ejected, the actuator 49 returns to its original position, causing a short displacement in the conveyor belt 51 and a much longer displacement of the stop 48 on which the parts of a new transversal alignment start to fall, to repeat the work cycle.

Figure 9:
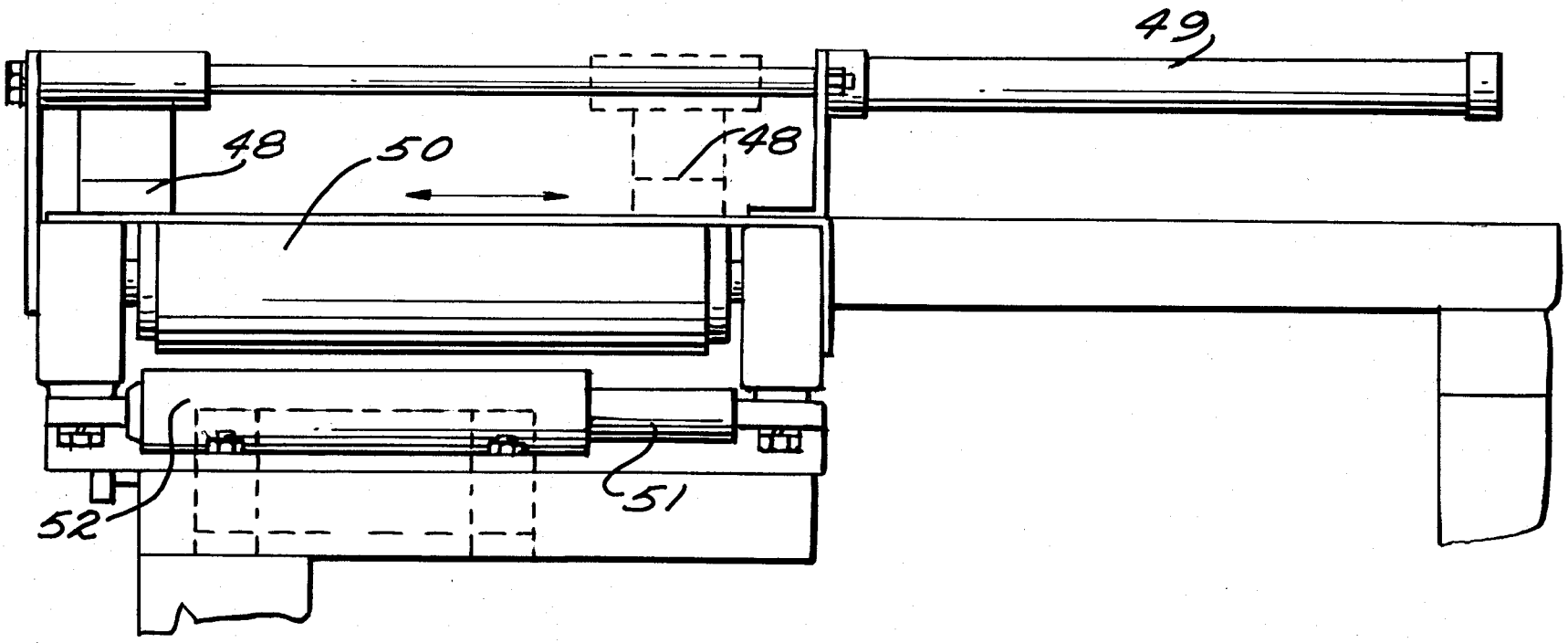
FIG. 9 shows a similar illustration to FIG. 7, but corresponding to the unloading area.
Figure 10:
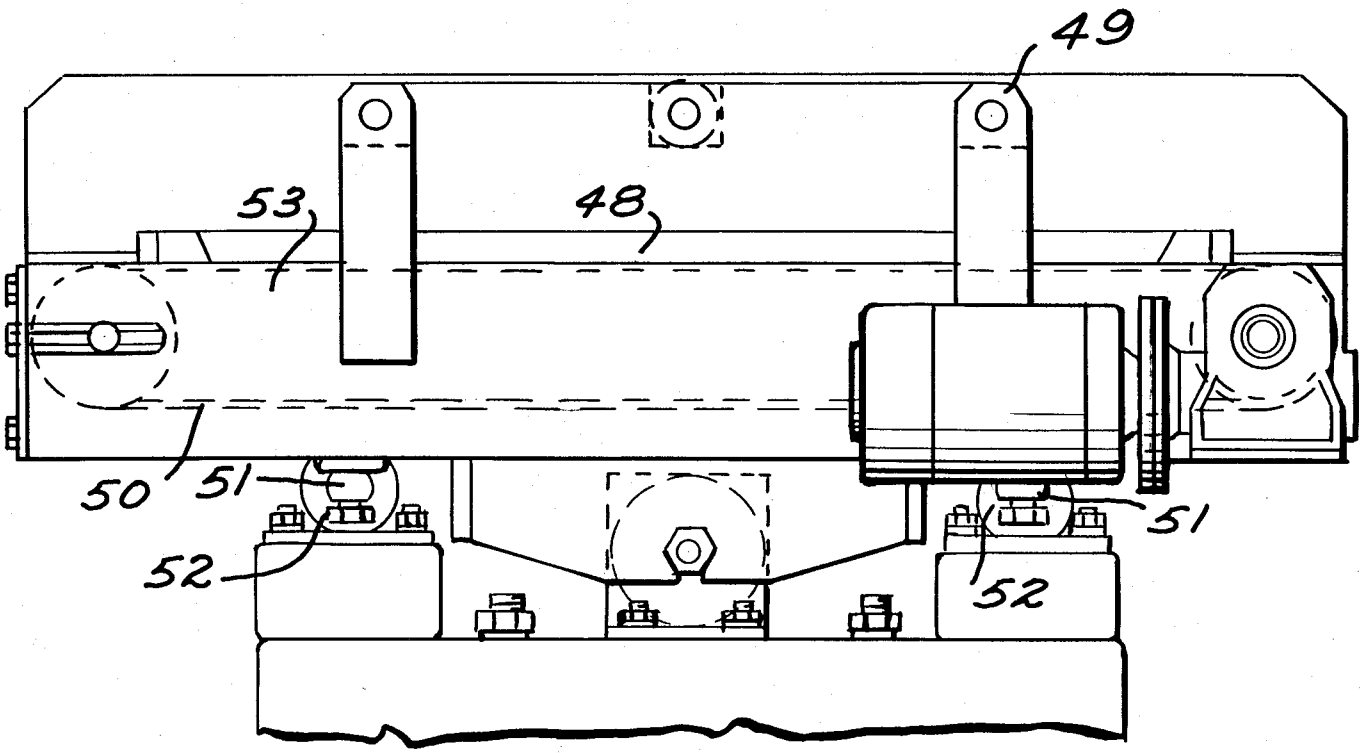
FIG. 10 shows, finally, a similar illustration to FIG. 8 and also corresponding to the unloading end.

In accordance with the functionality of this conveyor belt 50, sliding bars 51 will be included, installed on the respective supports 52, the drive motor of this belt being mounted on the mobile chassis itself 53, to which the sliding bars 51 are integrally joined, as can be seen in full detail in FIG. 9.

What is claimed is:

1. A kiln for firing heavy ceramic articles comprising a hearth including a transport surface portion, a loading and unloading end disposed at spaced ends of said hearth, a supporting chassis, means mounting said transport surface portion on said chassis so that said surface portion is movable relative to said chassis, means rigidly mounting said chassis in said kiln, drive means for imparting a predetermined vibratory motion to said surface portion, said drive means including an eccentric member whereby said motion is generally rearwardly and downwardly directed during a first portion of a vibratory cycle, said means mounting said transport surface portion including spring means and said drive means including releasing means so that upon release of said surface portion from said drive means, said surface portion will move, under the influence of said mounting means and spring means, upwardly and forwardly an extent sufficient to shift an article resting on said surface portion in a forward direction in said hearth toward said unloading end, said means mounting said surface portion including conduit means extending along at least a portion of said hearth below said transport surface portion for conveying cool air along said hearth exteriorally thereof, insulating material being disposed between said transport surface portion and said conduit means, said kiln further including first conveying means for conveying articles to be fired to adjacent said loading end of said surface portion, a second conveying means for receiving articles from said first conveying means and pusher means for moving articles from said second conveying means to said transport surface portion, said kiln including an unloading conveying means adjacent said unloading end, a detainer stop extending transverse to said unloading end and being movable by contact with articles discharged from said surface portion, an unloading conveyor means cooperating with said detainer stop to receive and periodically move articles received from said surface portion away from said unloading end of said kiln.

2. The kiln as claimed in claim 1 wherein said means mounting said surface portion on said chassis includes a plurality of arms each pivotally connected to said surface portion and said chassis, each arm being connected to opposed springs for damping movement of each said arm, each said arm having an elbow dividing each said arm into an upper section and a lower section with said upper section extending at an angle to said lower section toward the direction of intended movement of articles on said transport surface portion, said kiln further including another surface portion extending alongside said first-mentioned surface portion and being adapted to move articles in a direction opposite to the direction of said first-mentioned surface portion, said drive means for said first-mentioned surface portion being connected to said another transport surface portion.

3. The kiln as claimed in claim 2 wherein another drive means is provided to supply additional vibratory motion to said surface portions.

4. The kiln as claimed in claim 1 wherein said insulating material is a layer of refractory bricks fixed to tubular elements by means of screws having heads with said screws being inserted from the transport surface portion through said layer of bricks, said screws having lower ends which pass through cross members disposed adjacent said conduit means, said lower ends of each of said screws including spring means and locking means for retaining said spring means and said screws fastened through said bricks.

5. The kiln as claimed in claim 1 wherein said insulating material has portions interengaging with the wall of said kiln but with spaces provided between said interengaging portions to enable said insulating material to vibrate with said transport surface portion, said interengaging portions comprising a labyrinthic step to reduce heat losses through said interengaging portion.

6. A kiln as claimed in claim 1 wherein said transport surface portion includes a series of trays having upturned side walls, said trays being made from metal sheet material, there being provided between said conduit means and said trays a layer of heat resistant wool having a selected thickness.

7. The kiln as claimed in claim 2 wherein a slot is provided between said first-mentioned and said another transport surface portion, a partition being provided which is vertically shiftable in said slot.

8. The kiln as claimed in claim 6 wherein positioning rods are provided along the length of said hearth and in engagement with the upturned edges of each said tray, said two rods being of refractory steel.

9. The kiln as claimed in claim 1 wherein said first conveying means includes a sensing means cooperating with belt driving means for controlling the movement of said first conveying means, said second conveying means including detecting means which is effective to actuate said pusher means upon detecting ceramic parts on said second conveyor means.

10. The kiln as claimed in claim 1 wherein means are provided for aligning the articles exiting from said hearth, said means for aligning including timer means which periodically serves to actuate said aligning means.

11. The kiln as claimed in claim 1 wherein said first conveying means is a conveyor belt installed on a support chassis which includes a drive motor for said belt, said support chassis including two longitudinal sliding bars each mounted on respective fixed supports, and defining the spacing of said conveyor belt with respect to the kiln outlet end.

* * * * *